United States Patent [19]

Strohmeyer et al.

[11] Patent Number: 4,749,386

[45] Date of Patent: Jun. 7, 1988

[54] SAFETY FILTER FOR A VACUUM CLEANER

[75] Inventors: Rolf Strohmeyer; Horst Neugart, both of Wuppertal, Fed. Rep. of Germany

[73] Assignee: Vorwerk & Co. Interholding GmbH, Wuppertal, Fed. Rep. of Germany

[21] Appl. No.: 45,612

[22] Filed: May 4, 1987

[30] Foreign Application Priority Data

May 7, 1986 [DE] Fed. Rep. of Germany ... 8612468[U]

[51] Int. Cl.[4] ..... B03C 3/32; B03C 3/60

[52] U.S. Cl. ..... 55/131; 55/374; 55/380; 55/DIG. 2; 55/DIG. 3

[58] Field of Search ..... 55/126, 131, 380, 381, 55/374, 376, 377, 382, DIG. 3, DIG. 2

[56] References Cited

U.S. PATENT DOCUMENTS

| | | | |
|---|---|---|---|
| 1,783,240 | 12/1930 | Hoover | 55/380 X |
| 2,327,225 | 8/1943 | Taylor | 55/380 X |
| 2,800,194 | 7/1957 | Peek | 55/380 |
| 3,535,855 | 10/1970 | Howard et al. | 55/380 X |
| 3,577,705 | 5/1971 | Sharlit | 55/126 X |
| 3,930,815 | 1/1976 | Masuda | 55/131 X |
| 3,966,435 | 6/1976 | Penney | 55/131 |
| 4,376,642 | 3/1983 | Verity | 55/126 X |
| 4,473,382 | 9/1984 | Cheslock | 55/126 |
| 4,627,858 | 12/1986 | Jacob | 55/126 |

FOREIGN PATENT DOCUMENTS

| | | | |
|---|---|---|---|
| 3404395 | 8/1985 | Fed. Rep. of Germany | 55/126 |
| 464 | 1/1979 | Japan | 55/131 |
| 60433 | 4/1985 | Japan | 55/126 |

*Primary Examiner*—Kathleen J. Prunner

*Attorney, Agent, or Firm*—Walter Ottesen

[57] ABSTRACT

The invention is directed to a safety filter for an outlying filter cartridge of a hand-guided vacuum cleaner. The filter cartridge includes a rigid air-permeable jacket and accommodates a paper filter bag which is seated in the jacket. The safety filter is a bag corresponding to the form of the jacket and is made of electrostatically-charged non-woven fabric. The safety filter is mounted between the jacket and the paper filter bag.

1 Claim, 1 Drawing Sheet

SAFETY FILTER FOR A VACUUM CLEANER

BACKGROUND OF THE INVENTION

The invention relates to a safety filter for an outlying filter cartridge of hand-held vacuum cleaners. The filter cartridge is made of a rigid air-permeable jacket in which a filter bag made of paper is seated. If the jacket for this kind of filter cartridge is made of fabric and therefore not rigid, the jacket itself can serve as the safety filter. The jacket can be removed and cleaned for the situation that dirt escapes from the paper filter bag.

Filter cartridges can also be made of rigid air-permeable jackets made of non-woven fabric, for example. With such jackets, the foregoing is not possible because the jacket is stable as to its form and can only be cleaned with difficulty.

SUMMARY OF THE INVENTION

It is an object of the invention to provide an additional safety filter for a rigid, form-stable, air-permeable jacket which prevents the jacket from becoming dirty and impermeable.

The safety filter according to the invention is for an outlying filter cartridge of a hand-guided vacuum cleaner. The filter cartridge includes a rigid air-permeable jacket having an inner surface and accommodates a paper filter bag therein. According to a feature of the invention, the safety filter includes a bag made of electrostatically-charged non-woven fabric. The bag is configured to have the form of the jacket and is interposed between the jacket and the paper filter bag so as to cover the entire inner surface of the jacket.

In this way, the safety filter according to the invention affords the advantage that the air-permeable jacket of a filter cartridge which is rigid and difficult to clean, is protected against dirt in a simple manner.

BRIEF DESCRIPTION OF THE DRAWINGS

The invention will now be described with reference to the drawing wherein.

DESCRIPTION OF THE PREFERRED EMBODIMENTS OF THE INVENTION

Figure 1:
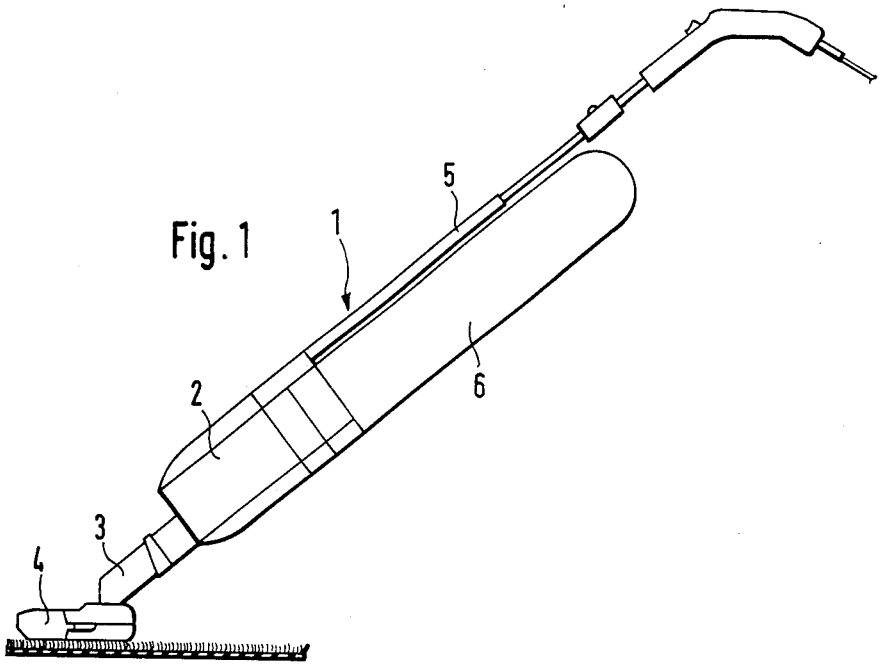
FIG. 1 is a side elevation view of a hand-guided vacuum cleaner having an outlying filter cartridge; and, FIG. 2 is a section view taken through the outlying filter cartridge having the supplementary safety filter according to the invention.

In FIG. 1, the hand-guided vacuum cleaner is identified by reference numeral 1. The vacuum cleaner includes a motor-blower housing 2 having a suction stub 3 mounted thereon. Nozzles 4 or the like can be connected to the stub 3. A guide wand 5 is mounted to the motor-blower housing 2 as is a so-called outlying or outboard filter cartridge 6.

Figure 2:
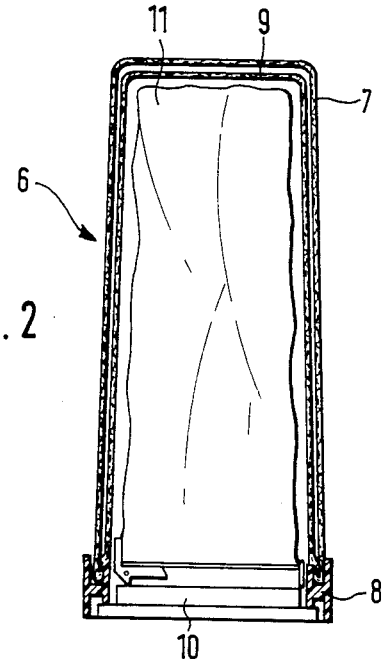

This filter cartridge 6 is shown in section in FIG. 2. The filter cartridge 6 comprises a rigid but air-permeable jacket 7. The jacket 7 is attached in a frame 8 which, in turn, is utilized for attachment to the motor-blower housing 2.

In addition, a safety filter 9 is likewise attached in this frame 8. This filter has the form of the air-permeable jacket 7; however, it is not rigid and is instead made of electrostatically-charged non-woven fabric and covers the entire inner surface of the jacket 7.

A cover 10 is mounted in the frame 8 which carries the paper filter bag 11 and which is inserted in the safety filter 9.

It is understood that the foregoing description is that of the preferred embodiments of the invention and that various changes and modifications may be made thereto without departing from the spirit and scope of the invention as defined in the appended claims.

What is claimed is:

1. A filter assembly for a hand-guided vacuum cleaner having a motor-blower housing and for accommodating a disposable filter bag in the assembly for collecting dust during vacuum cleaning, the filter assembly comprising:

a frame adapted to be attachable to the motor-blower housing;

a rigid, air-permeable jacket having a predetermined form and being attached to said frame and having an inner surface;

a fabric bag made of electrostatically-charged non-woven fabric and configured to have the form of said jacket and to define a cavity for receiving the disposable filter bag therein; and, said fabric bag being attached to said frame so as to cover said entire inner surface for protecting said jacket from any dust escaping from the disposable filter bag.

* * * * *